US008992348B2

(12) United States Patent
Meier et al.

(10) Patent No.: US 8,992,348 B2
(45) Date of Patent: Mar. 31, 2015

(54) TRAINING DEVICE, SYSTEM AND METHOD FOR IMPROVING A BASEBALL PLAYER'S SWING OF A BASEBALL BAT

(71) Applicants: Johnny M. Meier, West Allis, WI (US); Boe Baitinger, Oak Creek, WI (US)

(72) Inventors: Johnny M. Meier, West Allis, WI (US); Boe Baitinger, Oak Creek, WI (US)

( * ) Notice: Subject to any disclaimer, the term of this patent is extended or adjusted under 35 U.S.C. 154(b) by 91 days.

(21) Appl. No.: 13/739,108

(22) Filed: Jan. 11, 2013

(65) Prior Publication Data

US 2013/0178313 A1 Jul. 11, 2013

Related U.S. Application Data

(60) Provisional application No. 61/585,339, filed on Jan. 11, 2012.

(51) Int. Cl.

| | |
|---|---|
| ***A63B 71/00*** | (2006.01) |
| ***A63B 69/00*** | (2006.01) |
| *A63B 69/40* | (2006.01) |

(52) U.S. Cl.

CPC ..... *A63B 69/0002* (2013.01); *A63B 2069/401* (2013.01); *A63B 69/00* (2013.01); *A63B 69/0057* (2013.01); *A63B 69/0075* (2013.01); *A63B 2069/0008* (2013.01); *A63B 2210/50* (2013.01); *A63B 2225/093* (2013.01)

USPC ..... 473/417; 473/451; 473/422

(58) Field of Classification Search

CPC ..... A63B 2069/0008; A63B 69/0002; A63B 2225/093; A63B 2069/401; A63B 69/00

USPC ..... 473/417, 422, 453, 420, 446, 451; D21/717, 715

See application file for complete search history.

(56) References Cited

U.S. PATENT DOCUMENTS

| | | | | |
|---|---|---|---|---|
| D321,545 | S * | 11/1991 | Myers | D21/715 |
| 5,928,092 | A * | 7/1999 | Keeter et al. | 473/417 |
| 6,413,175 | B1 * | 7/2002 | Mooney, Jr. | 473/417 |
| 6,682,445 | B1 | 1/2004 | Tanner | |
| 6,878,077 | B2 * | 4/2005 | Andrews | 473/453 |
| 7,204,769 | B2 * | 4/2007 | Bandimere et al. | 473/417 |
| 7,281,998 | B2 | 10/2007 | Tanner | |
| D563,496 | S * | 3/2008 | Hawkins | D21/717 |
| 7,354,360 | B1 * | 4/2008 | Eckstein | 473/417 |
| 7,819,763 | B2 * | 10/2010 | Campbell et al. | 473/453 |
| 8,075,424 | B1 * | 12/2011 | Hostetler | 473/447 |
| 8,147,355 | B2 * | 4/2012 | Burgess | 473/417 |
| 8,262,515 | B2 * | 9/2012 | Morris | 473/420 |
| 8,556,753 | B1 * | 10/2013 | Dixon, Jr. | 473/417 |
| 2006/0264273 | A1 * | 11/2006 | Liao | 473/417 |
| 2007/0275793 | A1 * | 11/2007 | Liao | 473/417 |
| 2008/0085787 | A1 * | 4/2008 | Molloy et al. | 473/417 |
| 2009/0312123 | A1 * | 12/2009 | Liao | 473/417 |
| 2013/0178313 | A1 * | 7/2013 | Meier et al. | 473/417 |

* cited by examiner

*Primary Examiner* — Mitra Aryanpour

(74) *Attorney, Agent, or Firm* — Joseph S. Heino; Patrick M. Bergin

(57) ABSTRACT

A swing training device has an upright vertical support which is height-adjustable and multiple training attachments for working on a batter's different skill sets. The attachments include a regular batting tee, a "cast away" batting tee, an "in and out" batting tee, and a "perfect cut" batting tee. Each tee is interchangeable with the others, each being used with the vertical support.

11 Claims, 11 Drawing Sheets

TRAINING DEVICE, SYSTEM AND METHOD FOR IMPROVING A BASEBALL PLAYER'S SWING OF A BASEBALL BAT

This Application claims the benefit of U.S. Provisional Application No. 61/585,339, filed Jan. 11, 2012.

FIELD OF THE INVENTION

This invention relates generally to devices, systems and methods used to train baseball players. More specifically, this invention relates to a device, as well as to a system and a method, that is used to improve the swing technique of a bat by a baseball player.

BACKGROUND OF THE INVENTION

The sport of baseball is well known. As used in this description, the term "baseball" is intended by these inventors to include both baseball and softball. During the play of a baseball game, a single offensive player faces off against a pitcher and other defensive players who are strategically located near the bases and in the outfield. The pitcher throws a ball at or near a strike zone above home plate and the offensive player, the batter, attempts to hit the ball with a baseball bat. At any point in the game, the batter may need to use different batting strategies to advance the likelihood of scoring by the batter's team when it is at bat. The different batting strategies employ different swinging and hitting mechanics. Such swings must be practiced ahead of the game so that the batter learns proper technique and mechanics, thus improving the batter's skill with those different batting techniques and mechanics.

In the experience of the inventors herein, current batting training equipment is insufficient for accomplishing proper swing techniques and mechanics due to limited uses and skills emphasized. Accordingly, there is a need to provide a single device that can aid the batter in his or her training and improve batting techniques and mechanics during swinging practices. Of necessity, the single device should be capable of using interchanging attachments such that it can present a number of swinging options for the batter. Each interchanging attachment should also be easy to set up, employ a minimal number of parts and be easy to use. Further, the device should allow for use by different sized batters.

Accordingly, it is an object of the present invention to provide a new and useful training device, as well as a system and a method, for aiding a batter with training and with the practice of various batting swings. It is another object to provide such a training device that can use attachments that are interchangeable such that the batter can change up the swinging modes that are to be practiced. It is still another object to provide such a training device that is relatively compact when not in use, that is easy to assemble and disassemble, and that is easy to use by batters of different physical sizes.

SUMMARY OF THE INVENTION

The device of the present invention has obtained these objects. It provides for a swing training device that has an upright vertical support which is height-adjustable and that also has multiple training attachments for working on a batter's different skill sets. Although the names of the attachments are not a limitation of the present invention, the attachments include a regular batting tee, a "cast away" batting tee, an "in and out" batting tee, and a "perfect cut" batting tee.

Each tee is interchangeable with the others, each being used with a single support member, and the support member is height-adjustable.

The foregoing and other features of the training device of the present invention will be apparent from the detailed description that follows.

DETAILED DESCRIPTION

Figure 1B:
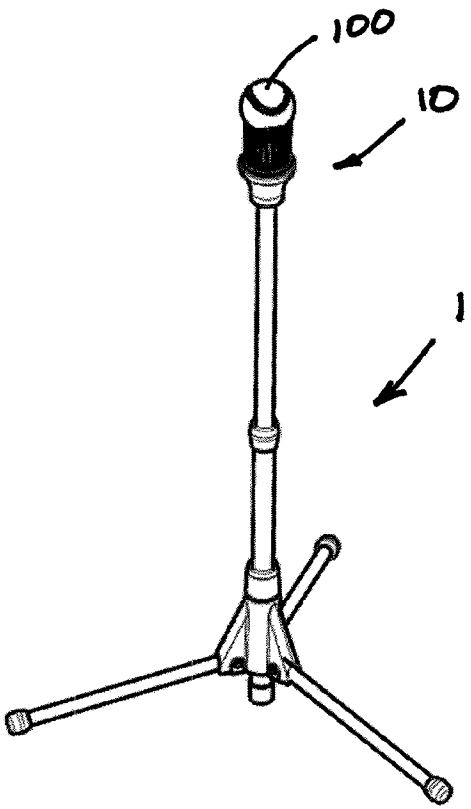
FIG. 1B is a top and side perspective view of the training device illustrated in FIG. 1A.
Figure 1A:
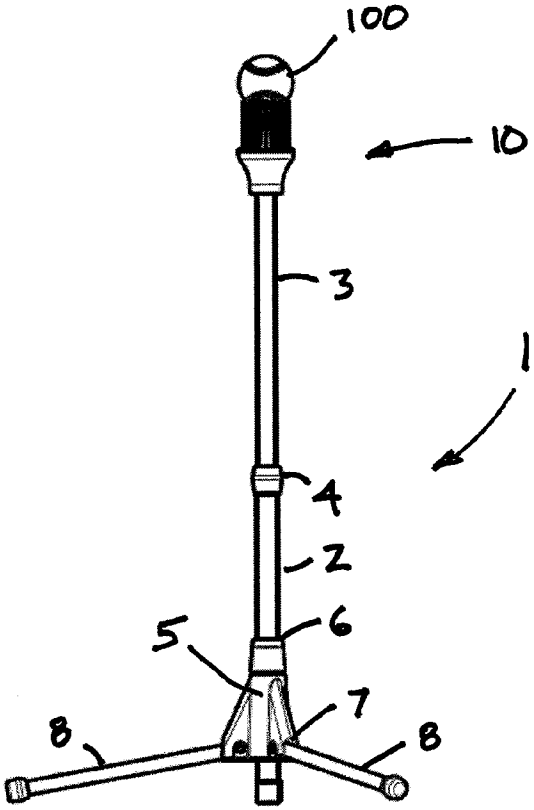
FIG. 1A is a front elevational view of the first embodiment of a training device that is constructed in accordance with the present invention.
Figure 1M:
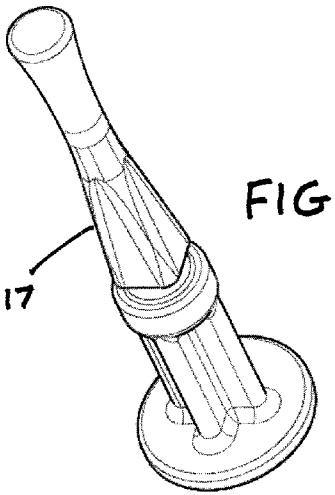
FIGS. 1K through 1M are greatly enlarged views of the post used with the brush support plate shown in FIGS. 1H through 1J.
Figure 1C:
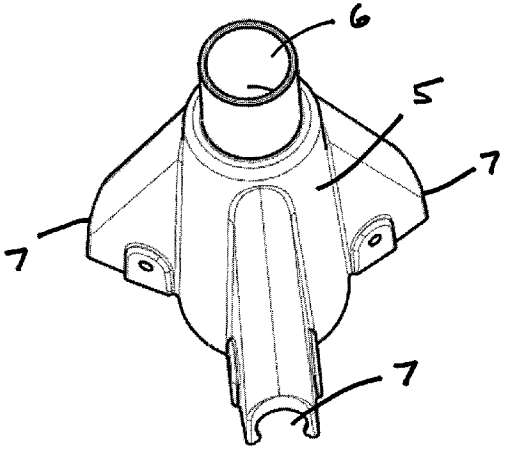
FIG. 1C is an enlarged top and front perspective view of the stand support base for the training device illustrated in FIG. 1A.
Figure 1K:
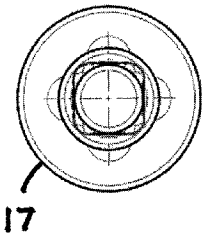
Figure 1L:
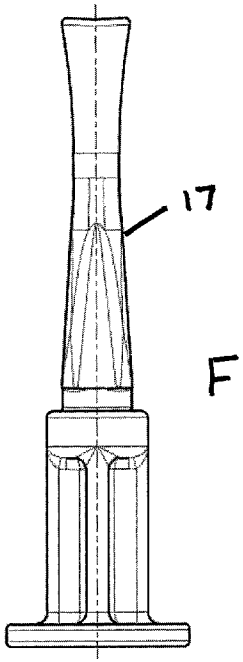
Figure 1E:
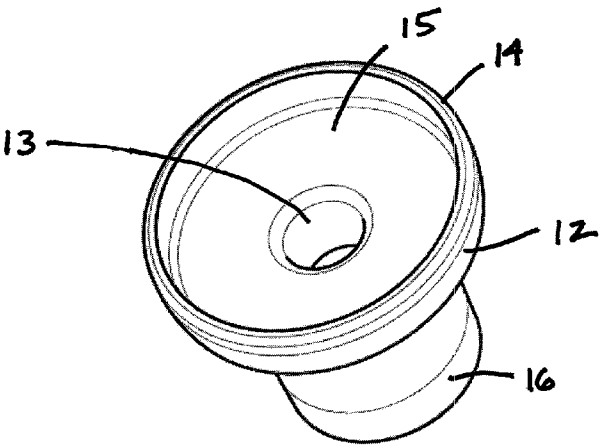
FIGS. 1D and 1E are bottom and top views, respectively, of the attachment illustrated in FIG. 1A.
Figure 1D:
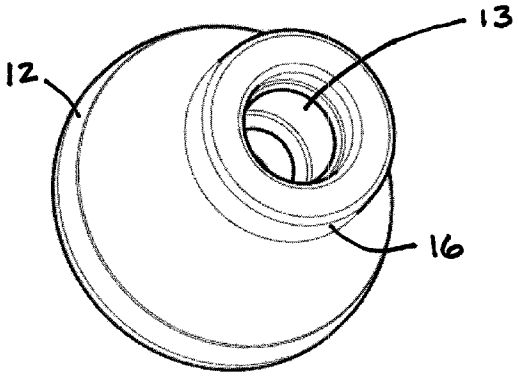
Figure 1G:
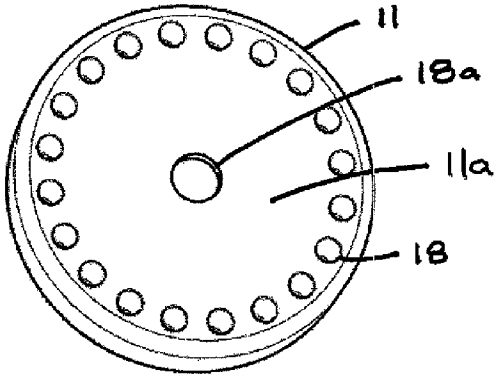
FIGS. 1F and 1G are enlarged views of the brush support plate used with the training device shown in FIG. 1A and the attachment shown in FIGS. 1F and 1G.
Figure 1F:
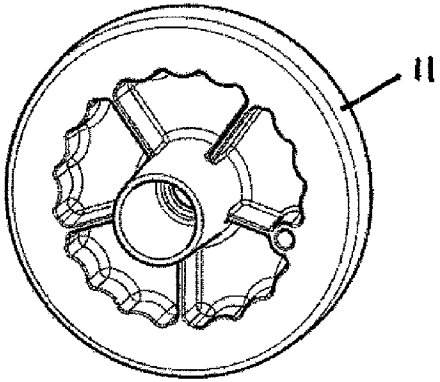
Figure 1J:
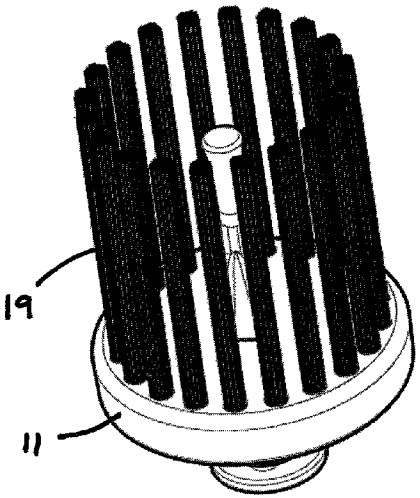
FIGS. 1H, 1I and 1J are side elevation, top and front perspective views, respectively, of the brush support plate with brushes inserted into the support plate for the training device shown in FIG. 1A.
Figure 1H:
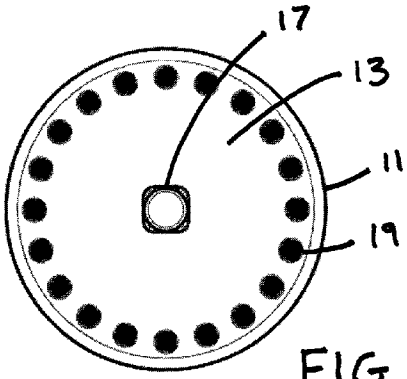
Figure 1I:
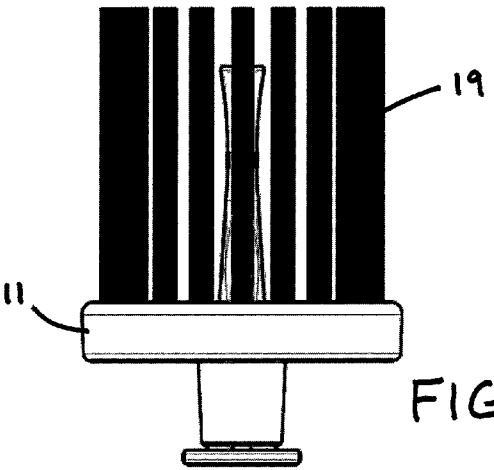

Referring now to the drawings in detail wherein like numbers represent like elements throughout, FIGS. 1A through 1J illustrate a preferred embodiment of a training device that is constructed in accordance with the present invention. FIG. 1A shows that the training device has a stand, generally identified 1, and a first alternative attachment, generally identified 10. It is to be understood that the stand 1 is the same stand 1 that will be used with each of the alternative attachments that will be presented in this detailed description.

In the preferred embodiment of the present invention, the stand 1 comprises a first tubular support member 2 and a second tubular support member 3. Each support member 2, 3 comprises a vertical axis. The diameter of the first support member 2 is greater than that of the second tubular support member 3 such that the second tubular support member 3 can slide within the first tubular support member 2. This way, the height of the attachment 10 can be varied depending upon the size of the batter. The relative position between the support members 2, 3 can be fixed by using a cam-type lock 4 or other suitable locking device. It should also be appreciated that the support members 2, 3 could be round tubular members or be configured in some other cross-sectional shape, such not being a limitation of the present invention. Further, it should be appreciated that the support members could be more than two in number. However, the support member or members should comprise a vertical axis and the support member or members should comprise a top-most portion and a bottom-most portion.

The bottom-most portion of the first support member 2 is inserted into a base member 5. In the preferred embodiment of the present invention, the base member 5 has a top aperture 6 for receiving the first support member 2 and three peripheral and outwardly directed bottom apertures 7. See FIG. 1C. It is to be understood that the base member 5 could have an alternative number of apertures or no apertures. That is, the base 5 could be a solid structure that provides footing for the support members 2, 3. In the preferred embodiment, however, each bottom aperture 7 is configured to receive a support leg 8 within it. Fastening means of conventional configuration are provided to ensure secure attachment of those structures to one another.

The first alternative attachment 10 is intended to support a ball 100 (again, a baseball or a softball) that is positioned atop the attachment 10. This is accomplished by use of a first attachment base 12 having an upper portion 14 and a bottom portion 16. See FIGS. 1D and 1E. The upper portion 14 includes a receiving aperture 15. The receiving aperture 15 has a diameter. The bottom portion 16 of the attachment base 12 of the first attachment 10 likewise includes a receiving aperture 13. Insertable within the bottom receiving aperture 13 is the top-most end of the second tubular member 3 of the stand 1. It is also understood that the top-most end of the second tubular member 3 could include structure to allow the first alternative attachment 10 to "snap-fit" onto the tubular member 3. Significantly, the first attachment member 10 is substantially aligned with the support member axis, as mentioned above. Insertable within the top receiving aperture 15 of the first attachment 10 is a brush support plate 11 as shown in FIGS. 1F-1J. The support plate 11 comprises a disk-like member that seats within the receiving aperture 15 of the attachment base 12. The upper face 11*a* of the support plate 11 includes a plurality of first apertures 18, the apertures 18 being disposed within a circle defined about the perimeter of the upper face 11*a* and each aperture 18 being adapted to hold a brush portion 19 within it. In this configuration, the ball 100 sits atop a plurality of such brush portions 19. A secondary aperture 18*a* is centrally disposed within the support plate 11. See FIG. 1G.

This first embodiment of attachment 10 provides a design which will allow a batter to practice his or her swing without working on any specific skill set. The brush top, or brush-like support portion, 19 will allow the batter to make proper contact with the ball 100 in order to develop back spin which, strategically, results in extra bases. In application, the batter positions the attachment 10 to simulate any pitch he or she chooses to work on, such as an inside pitch, a middle pitch, or an outside pitch. Again, it is important that the brush-like support portion 19 be substantially aligned with the support member axis.

It is to be noted that the circular array of brush-like support portions 19 is coupled with a centrally-disposed post 17. See FIGS. 1H, 1J and 1L through 1M. The post 17 is preferably made of soft rubber. The post 17 allows the ring of brush portions 19 to function better than competitive prior art products since it assures that the ball 100 stay on the tips of the bristles 19 and prevents the ball 100 from dropping down between the bristles 19. In previous products there was always a compromise—the bristles 19 need to be placed around a wide circle under the ball 100 as well to assure stability yet also be very soft so the bat can easily swing thru the matt of bristles 19. But if the bristles 19 are near the edge of the ball 100 and soft, then they easily spread open and the ball 100 falls in-between them. With the soft rubber post 17 in the center of the brushes 19, these two requirements can be independently tuned. That is, the center post 17 can be made to just support the weight of the ball 100 but also provide no ability to keep the ball 100 from falling off, and the bristles 19 can be made very soft around the outer perimeter of the ball 100 since all they do is keep the ball 100 in place. With this configuration, the ball 100 can withstand much more random vibration, accidental movement without falling off the attachment 10, while the assembly still provides a very soft target for the bat to swing through for batting practice.

Figure 2B:
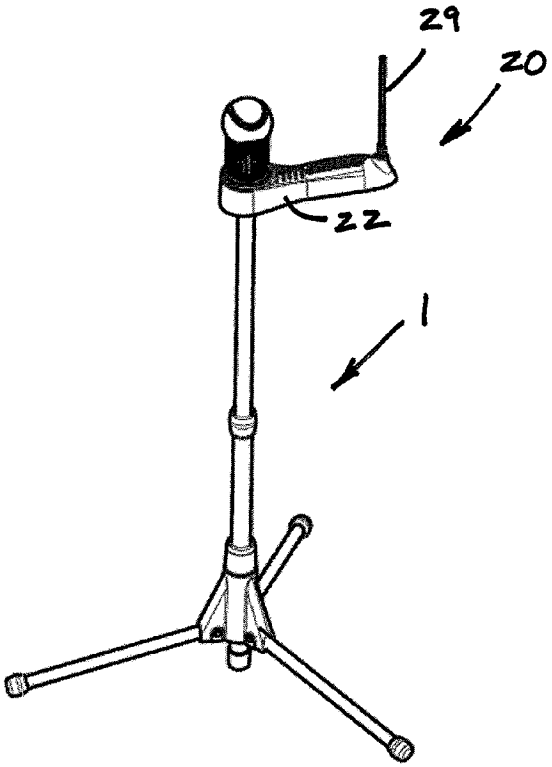
FIG. 2B is a top and side perspective view of the training device and attachment illustrated in FIG. 2A.
Figure 2A:
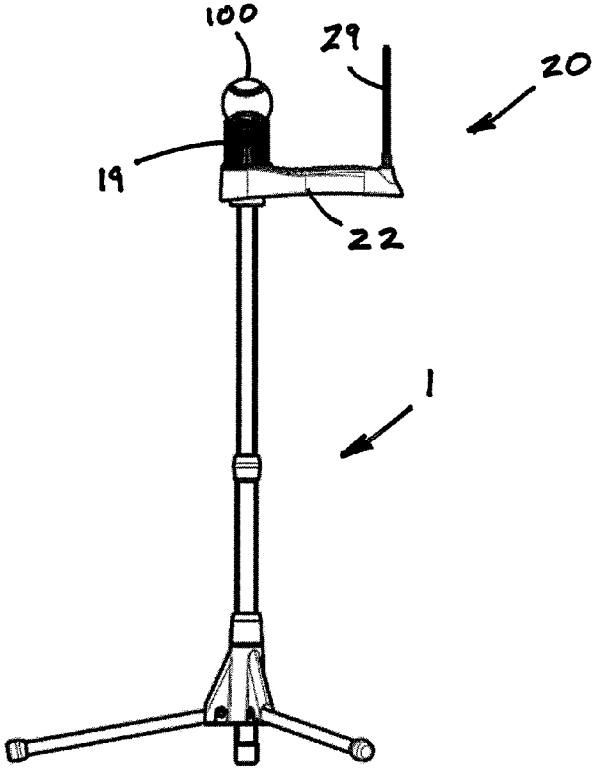
FIG. 2A is a front elevational view of a second embodiment of the training device and showing the device with the "cast away" attachment secured to it.
Figure 2C:
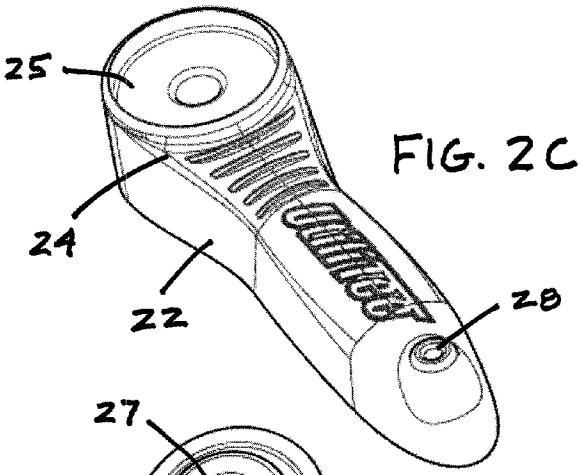
FIGS. 2C through 2G are enlarged front, top and left side perspective views of the "cast away" attachment shown in FIGS. 2A and 2B.
Figure 2D:
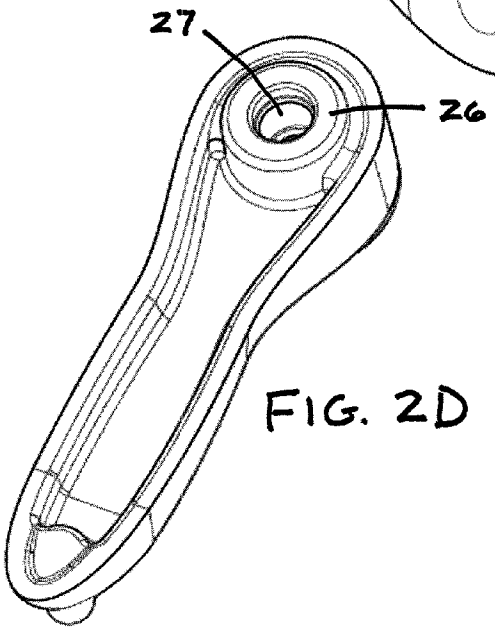
Figure 2E:
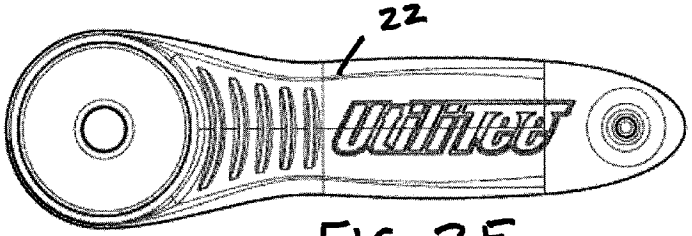
Figure 2F:
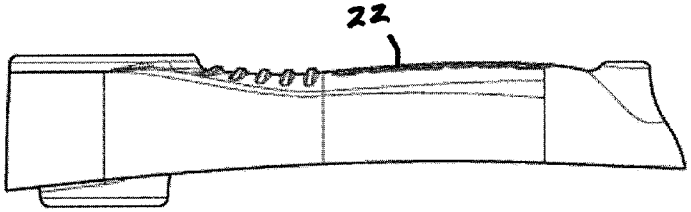
Figure 2G:
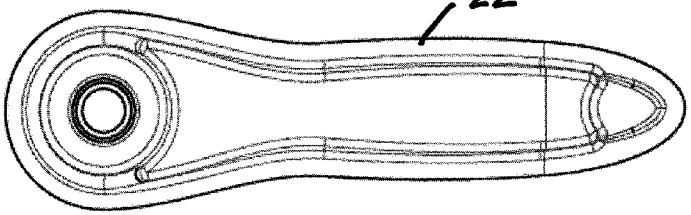

Referring now to FIGS. 2A through 2C, they illustrate the same stand 1 as discussed above and will not be further mentioned here. The second alternative attachment member, generally identified 20, comprises a second attachment base 22 having an upper portion 24 and a bottom portion 26. The upper portion 24 includes a first receiving aperture 25. The first receiving aperture 25 has a diameter. The upper portion 24 further includes a second receiving aperture 28. The bottom portion 26 of the second attachment base 22 of the second attachment 20 likewise includes a receiving aperture 27. Insertable within the bottom receiving aperture 27 is the top-most end of the second tubular member 3 of the stand 1. Insertable within the first top receiving aperture 25 of the second attachment 20 is the brush support plate 11 which was previously shown in FIGS. 1F-1J. Insertable within the second receiving aperture 28 is a post 29. This second attachment member 20 comprises structure whereby the brush-like support portion is substantially aligned with the support member 3 to which it is attached. The post 29, however, is offset from the support member axis.

This second attachment member 20 is identified by these inventors as the "cast away" attachment. As mentioned earlier in this detailed description, the names used with the various attachments are not a limitation of the present invention. These inventors have adopted names for the various attachments but other names can be used without deviating from the scope of the present invention. The structure and functionality of each attachment remains the same without regard to the names adopted and used in this description. This is true for the "cast away" attachment member 20 discussed here and for the other attachments also discussed herein.

The cast away attachment member 20 is designed for a batter to drive his or her hands inside the ball 100 while making proper contact with the barrel of the bat. The batter will set the ball 100 on the brush-like support portion 19 and position the post 29 where desired or required. As configured, the post 29 effectively rotates about the brush-like support portion 19 as may be desired or required by the user. The placement of the post 29 will force the batter to keep his or her hands inside the ball 100 in order to make contact with the ball 100 without hitting the post 29. This provides the instant feedback that the hitter needs in order to know if he or she is having a short, compact swing versus casting the hands creating a long, slow swing.

Figure 3B:
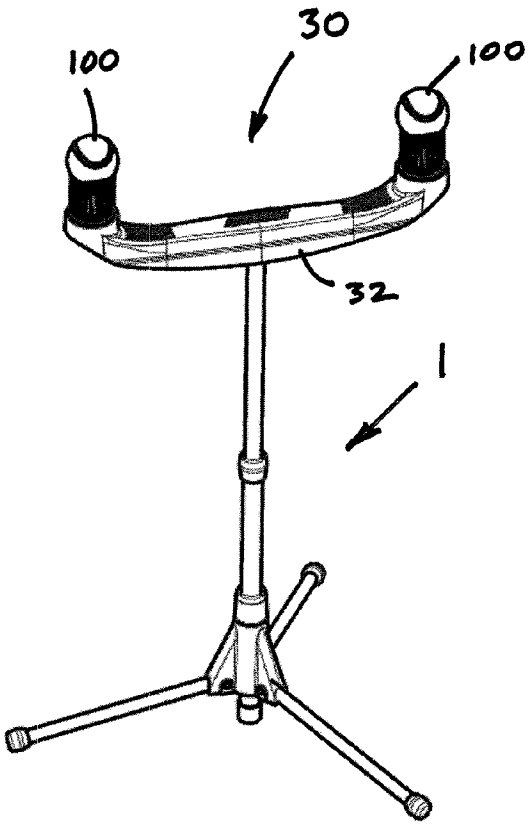
FIG. 3B is a front and top perspective view of the training device and attachment illustrated in FIG. 3A.
Figure 3A:
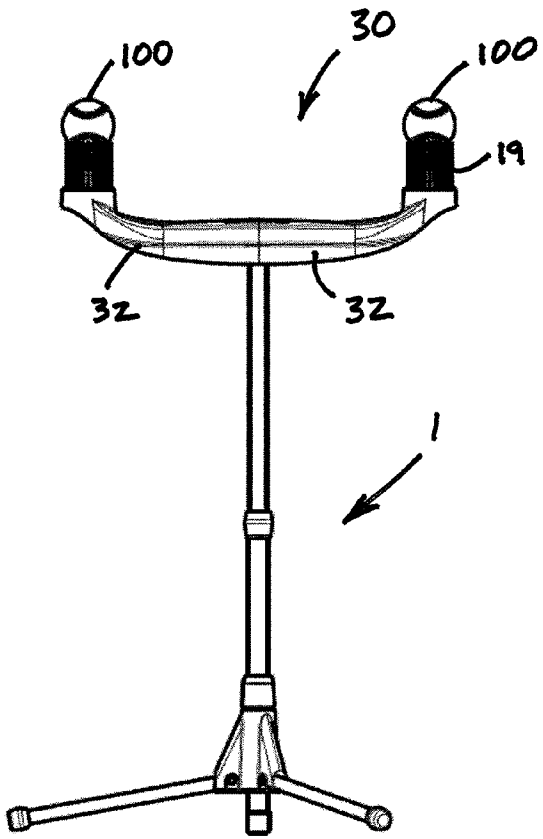
FIG. 3A is a front elevational view of a third embodiment of the training device and showing the device with the "in and out" attachment secured to it.
Figure 3C:
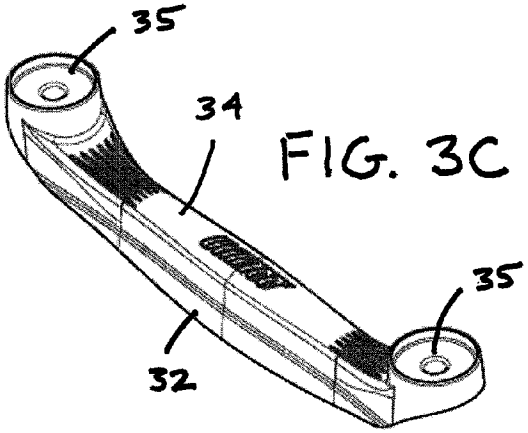
FIGS. 3C through 3G are enlarged top, front and left side perspective views of the "in and out" attachment illustrated in FIGS. 3A and 3B.
Figure 3D:
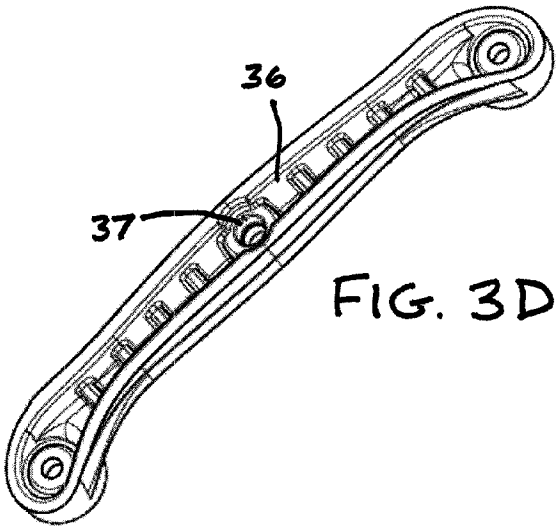
Figure 3E:
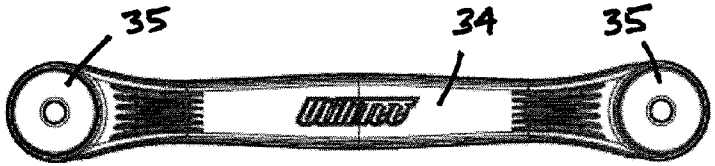
Figure 3F:
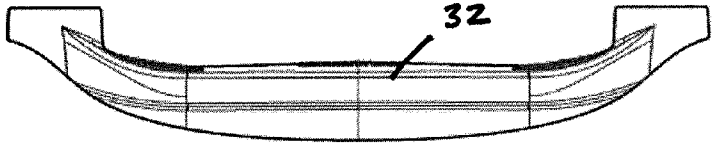
Figure 3G:
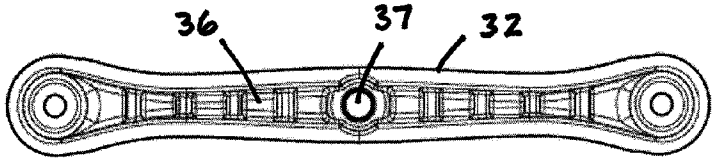

Referring now to FIGS. 3A through 3C, they include the same stand 1 as discussed above. The third alternative attachment, generally identified 30, comprises a third attachment base or attachment member 32 having an upper portion 34 and a bottom portion 36. The upper portion 34 includes a first receiving aperture 35. The first receiving aperture 35 has a diameter. The upper portion 34 further includes a second receiving aperture 38 and it too has a diameter. These apertures 35, 38 are disposed at opposite ends of the third attachment base 32 as shown in FIG. 3C. That is, each aperture 35, 38 places the brush-like support portions in an offset position relative to the axis of the support member 3. The bottom portion 36 of the third attachment base 32 of the third attachment 30 likewise includes a receiving aperture 37. Insertable within the bottom receiving aperture 37 is the top-most end of the second tubular member 3 of the stand 1. Insertable within each of the first and second top receiving apertures 35, 38 of the third attachment 30 is the brush support plate 11 which was previously shown in FIGS. 1F-1J. This third attachment member 30 is identified by these inventors as the "in and out" attachment. Again, the name of this attachment is not a limitation of the present invention.

The in and out attachment member 30 is designed to allow the batter to focus on hitting to all fields. The hitter will place two balls 100 on the attachment member 30, one on top of each brush top 19. The batter will hit the "inside" pitch first while maintaining proper balance to hit the second ball 100 which simulates the "outside" pitch. The attachment member 30 is approximately the length of home plate in order to provide a realistic approach to the inside and outside pitch. Its mobility around the plate allows hitters to work on all pitches within the strike zone. This attachment member 30 teaches hitters to hit the ball 100 in front of the plate on inside pitches, while also letting the ball "get deep" to the batter's back leg for the outside pitch.

Figure 4B:
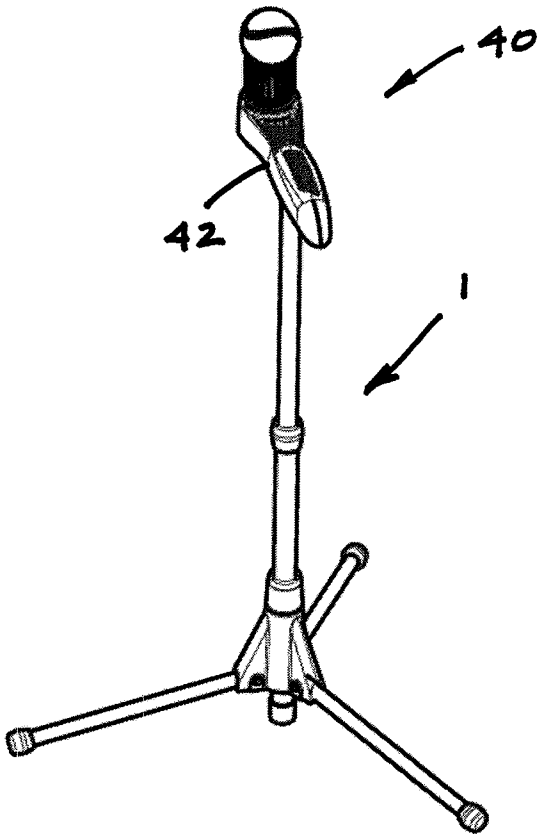
FIG. 4B is a top and front perspective view of the training device and attachment illustrated in FIG. 4A.
Figure 4A:
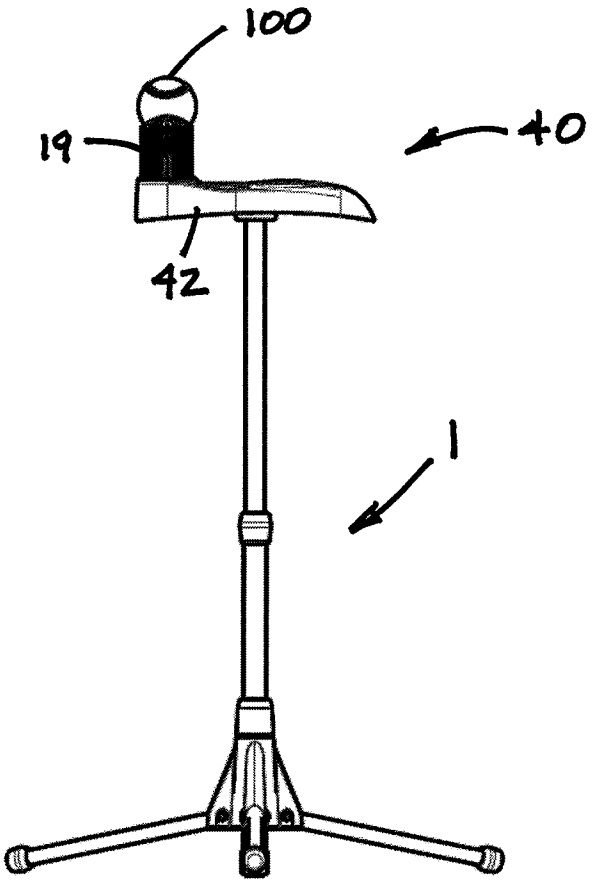
FIG. 4A is a front elevational view of a fourth embodiment of the training device and showing the device with the "perfect cut" attachment secured to it.
Figure 4C:
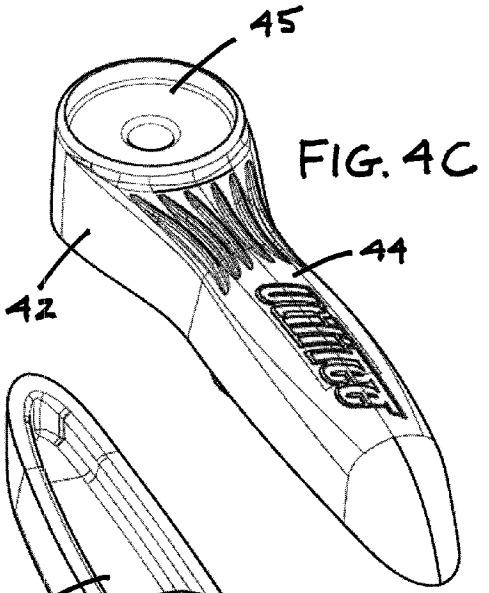
FIGS. 4C through 4G are front, top and left side elevational views of the "perfect cut" attachment illustrated in FIGS. 4A and 4B.
Figure 4D:
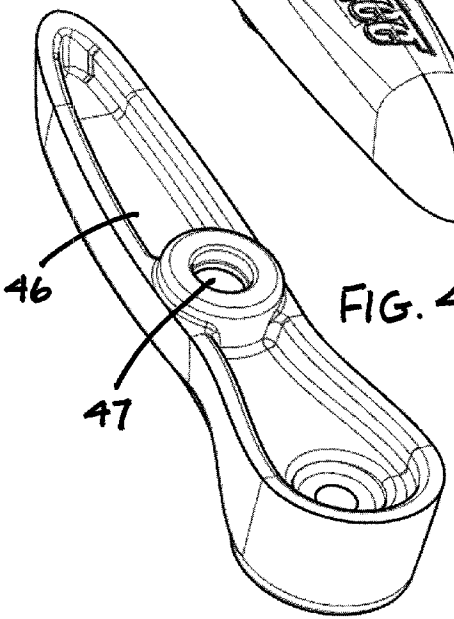
Figure 4E:
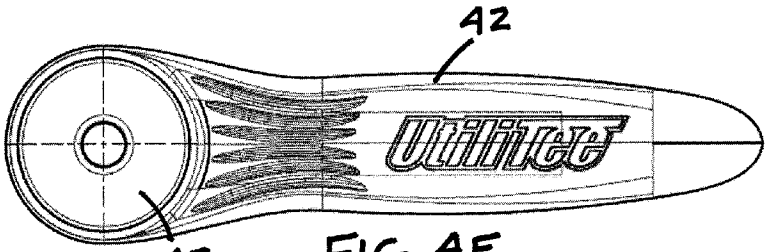
Figure 4F:
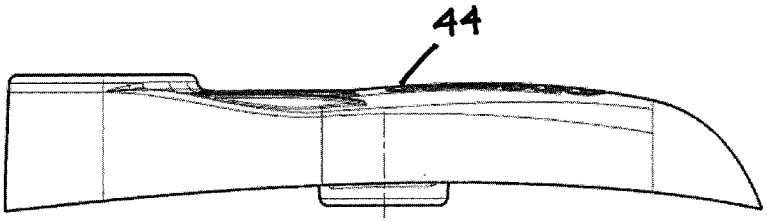
Figure 4G:
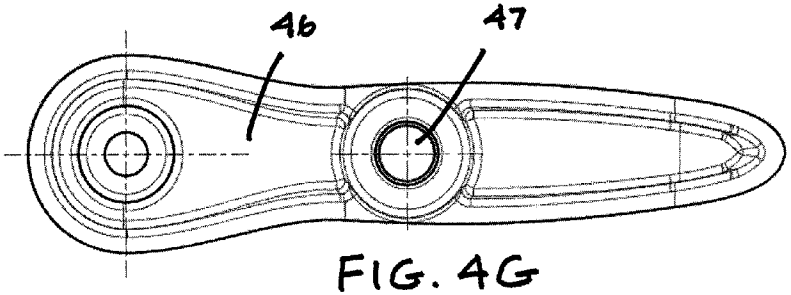

Referring now to FIGS. 4A through 4C, they also include the same stand 1 as is discussed above. The fourth alternative attachment member, generally identified 40, comprises a fourth attachment base 42 having an upper portion 44 and a bottom portion 46. The upper portion 44 includes a single receiving aperture 45. The receiving aperture 45 has a diameter. The bottom portion 46 of the fourth attachment base 42 of the fourth attachment 40 likewise includes a receiving aperture 47. Insertable within the bottom receiving aperture 47 is the top-most end of the second tubular member 3 of the stand 1, as described above and will not be repeated here. Insertable within the top receiving aperture 45 of the fourth attachment 40 is the brush support plate 11 which was previously shown in FIGS. 1F-1J. This fourth attachment member 40 is identified by these inventors as the "perfect cut" attachment member, which is not a limitation of the present invention. It is to be noted that this fourth attachment member 40 allows the brush top 19 to be offset from the axis of the support member 3.

The perfect cut attachment member 40 is designed to allow the hitter to focus on staying "on top" of the ball 100 to prevent fly balls while creating a short path to the ball 100. The hitter must maintain the proper path coming down onto the ball 100 to create backspin. If the hitter is to swing in an incorrect motion, he or she will make contact with the level plane 48 of the attachment member 40, thereby providing instant feedback in order to correct the mistake of dropping his or her hands, dipping, or upper cutting.

In view of the foregoing, it will be appreciated that the present invention provides for a swing training device that has an upright vertical support which is height-adjustable and that also has multiple training attachments for working on a batter's different skill sets. The attachments include a regular batting tee (or "attachment"), a "cast away" batting tee, an "in and out" batting tee, and a "perfect cut" batting tee. Each tee or attachment is interchangeable with the others, each being used with a single support member, and the support member is height-adjustable. Using these alternative tees improves the batter's performance and enhances training results.

The invention claimed is:

1. A baseball swing training device comprising:

at least one tubular support member having a vertical axis, the support member comprising a bottom-most portion and a top-most portion;

a base member attached to the bottom-most portion of the support member for positioning the at least one support member in a substantially vertical position; and a plurality of attachment members, each one of the plurality of attachment members being interchangeable with the other attachment members and each attachment member being attachable to at the top-most portion of the at least one support member, each attachment member comprising at least one top receiving aperture that is circular in shape and further comprising at least one baseball support plate that is circular in shape and sits within the top receiving aperture, the at least one baseball support plate comprising a center and a perimeter, the perimeter of the at least one baseball support plate comprising a plurality of upwardly-extending bristles, the bristles being arranged in a generally circular pattern and having a length, and the center of the at least one baseball support plate comprising a rubber post having a length that is shorter than the length of the bristles, the interchangeable attachment members comprising:

a first attachment member comprising a single baseball support plate, wherein the center of the plate is substantially aligned with the support member's axis;

a second attachment member comprising a single baseball support plate, wherein the center of the plate is substantially aligned with the support member's axis and a post that is offset from the support member's axis;

a third attachment member comprising a pair of opposing baseball support plates, both support plates being offset from the support member's axis; and a fourth attachment member comprising a single baseball support plate, offset from the support member's axis.

2. The training device of claim 1 wherein the at least one support member comprises a plurality of support members, the plurality of support members being vertically movable such that the device is height-adjustable.

3. The training device of claim 2 wherein the plurality of support members further comprises means for locking the support members in their relative vertical positions.

4. A baseball swing training system for a user comprising:

at least one tubular support member having a vertical axis, the support member comprising a bottom-most portion and a top-most portion;

a base member attached to the bottom-most portion of the support member for positioning the at least one support member in a substantially vertical position; and a plurality of attachment members, each one of the plurality of attachment members being interchangeable with the other attachment members and each attachment member being attachable to the top-most portion of the at least one support member, each attachment member comprising at least one top receiving aperture that is circular in shape and further comprising at least one baseball support plate that is circular in shape and sits within the receiving aperture, the at least one baseball support plate comprising a center and a perimeter, the perimeter of the at least one baseball support plate comprising a plurality of upwardly-extending bristles, the bristles being arranged in a generally circular pattern and having a length, and the center of the at least one baseball support plate comprising a rubber post having a length that is shorter than the length of the bristles, the interchangeable attachment members comprising:

a first attachment member comprising a single baseball support plate, wherein the center of the plate is substantially aligned with the support member's axis and configured to support a baseball for a first mode of practice hitting by the user;

a second attachment member comprising a single baseball support plate, wherein the center of the plate is substantially aligned with the support member's axis and further comprising a post, offset from the support member's axis, the baseball support portion being configured to support a baseball for a second mode of practice hitting by the user;

a third attachment member comprising a pair of opposing baseball support plates, both support plates being offset from the support member's axis and being configured to support a baseball for a third mode of practice hitting by the user; and a fourth attachment member comprising a single baseball portion plate, offset from the support member axis and configured to support a baseball for a fourth mode of practice hitting by the user.

5. The training system of claim 4 wherein the at least one support member comprises a plurality of support members, the plurality of support members being vertically movable such that the device is height-adjustable.

6. The training system of claim 5 wherein the plurality of support members further comprises means for locking the support members in their relative vertical positions.

7. A transformative baseball swing training method for providing, a user with different modes of practice hitting of a baseball, the method comprising the steps of:

including at least one tubular support member having a vertical axis, the support member comprising a bottom-most portion and a top-most portion;

including a base member attached to the bottom-most portion of the support member for positioning the at least one support member in a substantially vertical position;

including one of a plurality of interchangeable attachment members, the attachment member being selected from one of the group consisting of:

a first attachment member comprising a single brush tike baseball support plate, wherein the center of the plate is substantially aligned with the support member's axis and configured to support a baseball for a first mode of practice hitting by the user;

second attachment member comprising a single baseball support plate, substantially aligned with the support member's axis and a post that is offset from the support member's axis, the baseball support plate being configured to support a baseball for a second mode of practice hitting by the user;

a third attachment member comprising a pair of opposing support plates, both support plates being offset from the support member's axis and being configured to support a baseball for a third mode of practice hitting by the user; and a fourth attachment member comprising a single baseball support plate, offset from the support member's axis and configured to support a baseball for a fourth mode of practice hitting by the user;

placing the selected attachment member on the top-most portion of the at least one support member;

placing a baseball onto the selected attachment member;

practice hitting of the baseball so placed;

removing the selected attachment member and replacing the selected attachment with another and different attachment member;

placing the baseball onto the replacement attachment member; and practice hitting of the baseball so placed, thereby transforming the mode of practice hitting for the user.

8. The training method of claim 7 wherein the at least one support member providing step comprises providing a plurality of support members, the plurality of support members being vertically movable such that the device is height-adjustable.

9. The training method of claim 8 wherein the step of providing a plurality of support members further comprises the step of providing means for locking the support members in their relative vertical positions.

10. The training method of claim 7 wherein the like baseball support portions plates further comprise a plurality of upwardly-extending bristles, the bristles being arranged in a generally circular pattern and having a length.

11. The training method of claim 10 wherein the baseball support plates further comprise a rubber post having a length that is shorter than the length of the bristles.

* * * * *